US012121795B2

(12) United States Patent
Coman et al.

(10) Patent No.: US 12,121,795 B2
(45) Date of Patent: Oct. 22, 2024

(54) DEVICE, SYSTEM, AND METHOD FOR PLAYING A VARIATION OF BILLIARDS USING CROSS-SHAPED RACK

(71) Applicants: Timothy Scott Coman, Canton, MI (US); Michael Paul Hartmann, Saline, MI (US)

(72) Inventors: Timothy Scott Coman, Canton, MI (US); Michael Paul Hartmann, Saline, MI (US)

(73) Assignee: The Golden Cross LLC, Plymouth, MI (US)

( * ) Notice: Subject to any disclaimer, the term of this patent is extended or adjusted under 35 U.S.C. 154(b) by 0 days.

(21) Appl. No.: 17/730,166

(22) Filed: Apr. 26, 2022

(65) Prior Publication Data

US 2022/0339526 A1 Oct. 27, 2022

Related U.S. Application Data

(60) Provisional application No. 63/179,844, filed on Apr. 26, 2021.

(51) Int. Cl.
*A63D 15/00* (2006.01)

(52) U.S. Cl.
CPC ..... *A63D 15/005* (2013.01)

(58) Field of Classification Search
CPC ..... A63D 15/005
USPC ..... 473/40
See application file for complete search history.

(56) References Cited

U.S. PATENT DOCUMENTS

| | | | | |
|---|---|---|---|---|
| 3,399,890 | A * | 9/1968 | Galedrige | A63D 15/00 473/40 |
| 3,976,293 | A * | 8/1976 | Laureta | A63D 15/00 473/40 |
| 4,004,804 | A * | 1/1977 | Gholson | A63D 15/00 473/40 |
| 5,026,052 | A * | 6/1991 | Shelnutt | A63D 15/00 473/18 |
| 6,537,156 | B1 * | 3/2003 | Stagg | A63D 15/005 473/1 |
| 2006/0172809 | A1 * | 8/2006 | Woods, Sr. | A63D 15/00 473/20 |
| 2022/0339526 | A1 * | 10/2022 | Coman | A63D 15/005 473/40 |

* cited by examiner

*Primary Examiner* — Mitra Aryanpour
(74) *Attorney, Agent, or Firm* — Thomas P Heed; Heed Law Group PLLC

(57) ABSTRACT

A cross-shaped billiards rack is disclosed. The cross-shaped billiards rack allows players to use a standard billiard table, with standard object balls and cue balls, and play a variation of billiards. A variety of methods for playing billiard games with the cross-shaped rack are disclosed. The cross-shaped billiards rack can be used to form a 9-ball cross; a 5-ball mini-cross; or a 7-ball unbalanced cross.

12 Claims, 8 Drawing Sheets

DEVICE, SYSTEM, AND METHOD FOR PLAYING A VARIATION OF BILLIARDS USING CROSS-SHAPED RACK

FIELD OF INVENTION

This invention relates to the classification for sports, games, and amusements; and to the sub-classification for billiards. Specifically, this invention is device, system, and method for playing a variation of billiards based off of a cross-shaped rack.

BACKGROUND OF INVENTION

Billiards typically refers to any of various games played on a billiard table in which cues are used to strike balls against each other or into pockets around the edge of the table. North America has a popular variation referred to as pool, played on a 7-9 foot billiard table. As used in this patent application, billiard will refer to the North American version of billiards as further described herein.

The billiard table is rectangular, meaning that it has two long edges and two short edges. The playing surface is covered in felt, traditionally green. The billiard table has rails about the perimeter of the rectangular playing surface, also lined with felt. Although continuous, the rails can be segmented as two long rails and two short rails. The two long rails being arranged parallel to the long edge of the billiard table and the two short rails being arranged parallel to the short edge of the billiard table. The billiard table has six pockets, one in each corner and one, each, at the center-point of the long rail. The cue stick is used by a player to strike the cue ball, which, in turn, will hit one or more of the 15 object balls.

The most common game of billiards or pool is 8-Ball. Eight ball is a call shot game played with a cue ball and the object balls. One player must sink the solid object balls (numbers 1-7). The other player must sink the striped object balls (numbers 9-15). The player pocketing his or her group first and then legally pocketing the 8-ball wins the game.

To begin the game, the object balls are racked in a triangle at one end of the table with the 8-ball in the center of the triangle. All fifteen object balls are placed in the rack, with the 8-ball in the center. A striped ball should be on one corner and a solid ball on the other corner. The head ball is located on the appropriate dot on the billiards table. The object balls are forced towards the front of the rack with the fingers and the rack is vertically and carefully removed. One player shoots the cue ball at the racked object balls. This is called the "break." The break will typically result in one or more object balls caroming into a pocket. If a solid object ball is the first ball in a pocket, the person who broke will play the low balls. If a striped object ball is the first ball in a pocket, the person who broke will play the high balls.

Although popular and easy to learn, most players become bored after achieving a certain proficiency at billiards. Part of the problem is that the only well-defined and well-known game played on a billiards table is 8-ball. What the market needs is other well-defined and easy-to-learn games that can be played with a standard pool table, cues, cue ball, and object ball.

The present invention is a simple cross-shaped rack intended to rack 9 billiard balls, allowing participants to play a different game than 8-ball. The new game is called Conquer the Cross, and it can be played by one player or multiple players.

SUMMARY OF INVENTION

This summary is intended to disclose the present invention, a device, system, and method for playing a variation of billiards using a cross-shaped rack. The embodiment and description are used to illustrate the invention and its utility and are not intended to limit the invention or its use. The following presents a simplified summary of the primary embodiment of the invention to provide a basic understanding of the invention. Additional concepts that can be added or varied with the primary embodiment are also disclosed. The present invention is novel with respect to the prior art, and can be distinguished from the prior art.

Certain terminology is used in the following summary for convenience only and is not intended to be limiting. The article "a" is intended to include one or more items, and where only one item is intended the term "one" or similar language is used. To assist in the description of the present invention, words such as before, after, first, second, near, far, short, long, top, bottom, side, upper, lower, front, rear, inner, outer, right and left are used to describe the relative sequence, order, proximity, size, and orientation of aspects of the present invention, a device, system, and method for playing a variation of billiards using a cross-shaped rack. The terminology includes the words above specifically mentioned, derivatives thereof, and words of similar import.

The cross-shaped billiards rack device is fabricated from at least one of wood, steel, zinc, aluminum, nylon, glass-filled nylon, engineered thermoplastic polyurethane ("ETPU"), acrylonitrile butadience styrene ("ABS"), thermoplastic copolyester ("TPC"), high density polyethylene ("HDPE"), low density polyethylene ("LDPE"), polypropylene ("PP"), glass-filled PP, polyethylene terephthalate ("PET"), biaxially-oriented PET ("Mylar"), thermoplastic elastomer ("TPE"), methyl methacrylate ("Acrylic"), and polycarbonate ("PC"). A template rack can be fabricated from Mylar to create the cross, with a depressed hole in the template within which each object ball comprising part of the cross is to be placed.

The cross-shaped rack device has a void definable center with four void members radiating from the void definable center. The void definable center and the four void members are all contained within a continuous side edge of the cross-shaped rack device. For reference, only, when viewed from above, there is a right void member; a lower void member; a left void member; and an upper void member.

Each void member has a first straight side edge that transitions to a semi-circular side edge that transitions to a second straight side edge. The first straight side edge and the second straight side edge are parallel to one another at a distance slightly greater than an object ball. There is a flange extending orthogonally from the side edges. There is a bottom edge. The members are connected to one another with fillets. As viewed from above, the upper void member lies between the left void member and the right void member. The upper void member is orthogonal to both the left void member and the right void member. Likewise, the lower void member lies between the left void member and the right void member. The lower void member is orthogonal to both the left void member and the right void member.

The right void member and the lower void member each have an "X" on an upper flange. The two "X" indicate to the player from which edge the racked object balls are to be pushed. The lower void member and right void member are longer than upper void member and the left void member.

Ideally, the lower void member and the right void member are 9 mm longer than the upper void member and the left void member.

The cross-shaped rack device is used in a system with a billiard table, cue sticks, a plurality of object balls numbering at least 5, and a cue ball. The cross-shaped rack device arranges the nine object balls into a cross. In one variation, the cross-shaped rack device is used to arrange five object balls into a mini-cross. In another variation, the cross-shaped rack device is used to arrange seven object balls into an unbalanced cross.

In the main embodiment, the cross-shaped rack device is constructed so that 9 object balls are arranged in a cross on the playing surface of a standard, six-pocket billiard table. The cross-shaped billiards rack creates a nine-ball pattern called a cross, with a center ball and four pairs of object balls, at ninety-degree increments, radiating away from the center ball. In the main embodiment, the cross-shaped rack device is oriented so that the cross has a center ball with a first pair of object balls that are orthogonal to and adjacent with a first long rail. The cross has a second pair of object balls that are orthogonal to and adjacent with a first short rail. The cross has a third pair of object balls that are orthogonal to and adjacent with a second long rail. The cross has a fourth pair of object balls that are orthogonal to and adjacent with a second short rail.

In one implementation of play, a player places one perimeter object ball in front, and directly in the center, of each of the six pockets. The player uses the cross-shaped billiards rack device to rack the remaining nine object balls. The player orients the cross so that one of the pairs of balls in the cross is orthogonal to and adjacent with each of the two short rails and two long rails. The player places the cue ball anywhere on the table;

The player uses a cue to strike the cue ball so as to sink at least a first perimeter object ball into a pocket without having any perimeter object ball, or the cue ball, impact the cross. Using the cue to strike the cue ball is referred to as taking a shot. The player then takes shots, sequentially, to sink a second, third, fourth, fifth, and sixth perimeter object ball, without having any ball impact the cross. At least one perimeter object ball must go into a pocket with each shot.

Once perimeter object balls one through six are sunk the player takes a shot so as to hit one or more object balls in the cross. This is referred to as breaking the cross. The player must get at least one object ball into a pocket when breaking the cross. The player continues to take shots, sequentially, so that at least one of the remaining object balls goes into a pocket with each shot, until such time as there are no object balls remaining on the table.

In a variation, a mini-cross composed of 5 object balls, instead of 9, is used. The mini-cross is broken like the regular cross using the cue ball. In another variation, an unbalanced cross composed of 7 object balls, instead of 9 object balls, is used. The unbalanced cross is broken like the regular cross using the cue ball. Game play can continue normally with either a mini-cross or an unbalanced cross.

The primary method of this invention is comprised of the steps of employing a six-pocket billiard table, having two long rails and two short rails; selecting a game objective; using a plurality of object balls numbering at least five; using a cue ball; racking at least five object balls using a cross-shaped rack device; orienting the cross; removing the rack; placing optional perimeter object ball(s); placing the cue ball anywhere on the playing surface; taking a shot; sinking a first object ball; continuing to take shots while sinking object balls; exchanging players if no object ball is sunken during a shot; continuing until all object balls are sunk or until the game objective is violated.

The cross-shaped rack device allows participants to play billiard games with a variety of game objectives. In the first embodiment, the game objective entails employing 15 object balls. Nine object balls are put in a cross. Although there are six object balls remaining, fewer than six may be used as perimeter object balls. In fact, the game can be played without any perimeter balls. If perimeter balls are used, the perimeter object balls are placed in front of the pockets. Game play begins. The perimeter object balls are sunk without disturbing the cross. Once there are no more perimeter object balls on the playing surface, the cross is broken. If a player disturbs the cross prior to sinking all of the perimeter object balls, the player loses for violating the game objective.

In a second embodiment, the game objective mirrors that employed in the first embodiment, but a mini-cross composed of 5 object balls is used. Although there are ten object balls remaining, fewer than ten may be used as perimeter object balls. In fact, the game can be played without any perimeter balls. If perimeter balls are used, a maximum of six perimeter object balls are placed in front of the pockets. The remaining perimeter object balls can be incorporated in game play, if desired, although they are not necessary. The perimeter object balls are sunk without disturbing the mini-cross. Once there are no more perimeter object balls on the playing surface, the mini-cross is broken. If a player disturbs the mini-cross prior to sinking all of the perimeter object balls, the player loses for violating the game objective.

In a third embodiment, the game objective also mirrors that employed in the first embodiment, but with an unbalanced cross composed of seven object balls. Although there are eight object balls remaining, fewer than eight may be used as perimeter object balls. In fact, the game can be played without any perimeter balls. If perimeter balls are used, a maximum of six perimeter object balls are placed in front of the pockets. The remaining perimeter object balls can be incorporated in game play, if desired, although they are not necessary. The perimeter object balls are sunk without disturbing the unbalanced cross. Once there are no more perimeter object balls on the playing surface, the unbalanced cross is broken. If a player disturbs the unbalanced cross prior to sinking all of the perimeter object balls, the player loses for violating the game objective.

In a variation of the game objective that can used with any of embodiments one through three, an opponent may dictate the order in which the perimeter object balls are to be sunk.

In another variation of the game objective that can used with any of embodiments one through three, fewer than six perimeter object balls may be placed in front of fewer than six pockets. In this variation, the cross, mini-cross, or unbalanced cross is broken to start the game. The players have to sink all of the object balls used in the cross, mini-cross, or unbalanced cross, prior to sinking the perimeter object balls that have been placed in front of the pockets. If a player disturbs or sinks any of the perimeter object balls, the player loses for violating the game objective.

In an alternative embodiment, a player must call the object ball for each shot. In an alternative embodiment, a player must call the object ball and pocket for each shot. In another alternative embodiment, the cue ball must strike the object ball the player intends on sinking, prior to the cue ball hitting any other object balls. In another alternative embodiment, an opponent identifies the object ball to be sunk with each shot, consistent with the game objective.

The game objectives of embodiments one through three may also include scoring. For example, with embodiment one, a point system can be established whereby the perimeter object balls are worth one point a piece; the first eight balls of the cross 100 are worth two points each; and the final ball from the cross 100 is worth three points. A perfect game using this scoring system on embodiment one would yield 25 points.

In an alternative embodiment, when playing versus an opponent, a series of games can be played until one of the players reaches a pre-determined point goal (i.e., 100 points). In an alternative embodiment with multiple players, a pre-determined number of games can comprise a series. The player with the highest point total in the series wins.

In an alternative embodiment using a scoring system, the players can be reset to the beginning of a game whenever a player misses or clears the table.

In an alternative embodiment using a scoring system with multiple players, a score can be tabulated for each player in each game. A series can be an odd number of games. The winner is the player who wins the most games in a series, regardless of aggregate score.

Each of the three variations of cross created by the rack-shaped cross device (cross, mini-cross, and unbalanced cross) has a center ball with object balls radiating away from the center ball. For the cross and mini-cross, balls radiate away from the center ball in 90-degree increments. For example, the cross has four pairs of object balls at 90-degree increments radiating away from the center ball of the cross. The cross-shaped rack device is oriented so that a first pair of object balls is adjacent to, and orthogonal with a first long rail of the billiard table. This ensures that a second pair of object balls is adjacent to, and orthogonal with, a first short rail of the billiard table; a third pair of object balls is adjacent to, and orthogonal with, a second long rail; and a fourth pair of object balls is adjacent to, and orthogonal with, a second short rail. The mini-cross and unbalanced cross would be oriented in a similar fashion, except that (1) the mini-cross would only have a single ball radiating away from the center ball; and (2) the unbalanced cross would not have a fourth pair of object balls.

Any of the cross variations can also be oriented so that the object ball pairs radiates towards the pockets.

The user puts their thumbs into the rack at the X to insure a tight configuration.

BRIEF DESCRIPTION OF THE DRAWINGS

The present invention is illustrated with 8 figures on 8 sheets. The accompanying drawings are incorporated in and constitute a part of this disclosure. The figures are intended to illustrate various embodiments of the invention. The present invention, a device, system, and method for playing a variation of billiards using a cross-shaped rack relies on a cross-shaped rack device.

DETAILED DESCRIPTION

This description is intended to disclose the present invention, a device, system, and method for playing a variation of billiards using a cross-shaped rack. This description is not intended to limit the scope of the claimed subject matter. Rather, this description is intended to build upon the summary. The device, system, and method for playing a variation of billiards using a cross-shaped rack uses a cross-shaped rack device.

Certain terminology is used in the following description for convenience only and is not limiting. The article "a" is intended to include one or more items, and where only one item is intended the term "one" or similar language is used. To assist in the description of the present invention, words such as before, after, first, second, near, far, short, long, top, bottom, side, upper, lower, front, rear, inner, outer, right and left are used to describe the relative sequence, order, proximity, size, and orientation of aspects of the present invention, a device, system, and method for playing a variation of billiards using a cross-shaped rack. The terminology includes the words above specifically mentioned, derivatives thereof, and words of similar import.

The present invention, a device, system, and method for playing a variation of billiards using a cross-shaped rack, is comprised of a device, a system aspect, and a method.

Figure 4:
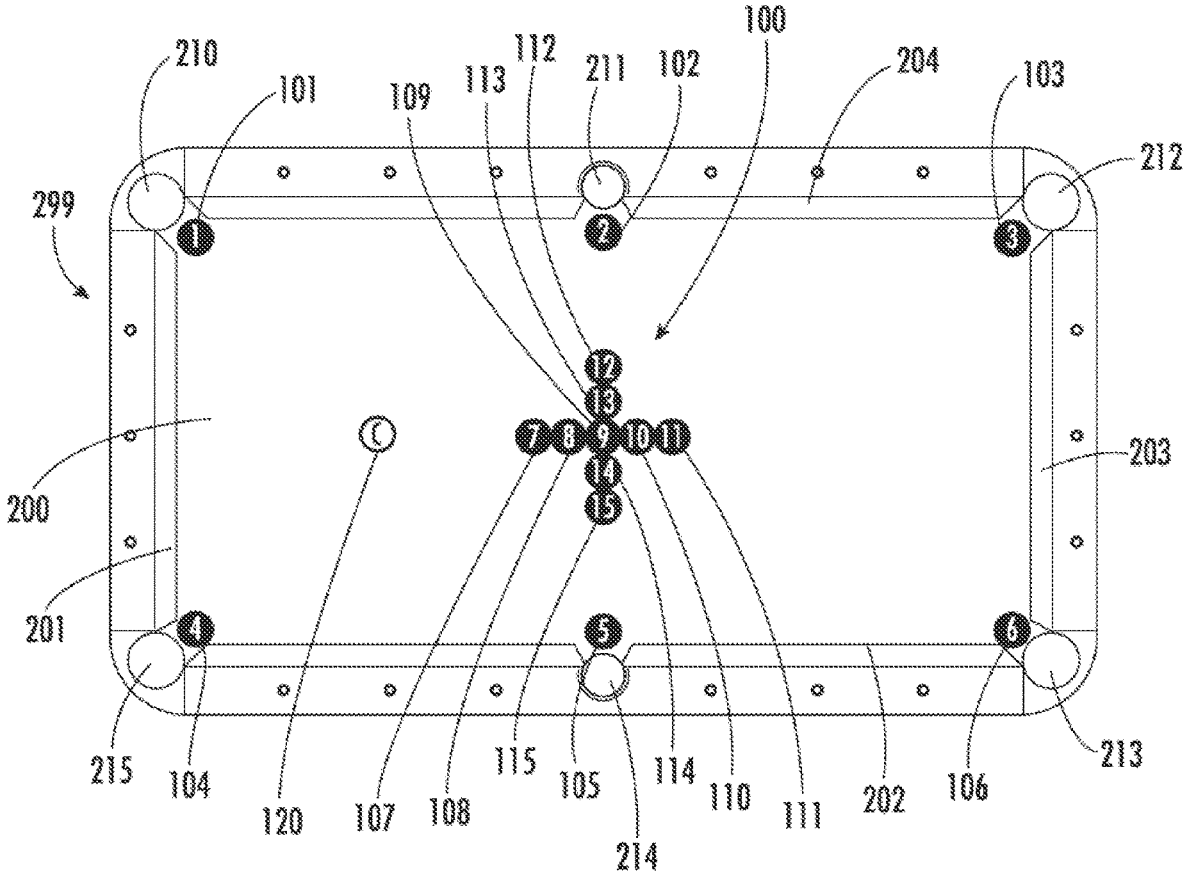
FIG. 4 is a top view of the 15 object balls being arranged on a standard billiards table using the cross-shaped rack device, in preparation for playing Conquer the Cross.

FIG. 4 illustrates the system. The playing surface 200 of a standard, six-pocket billiard table 299 is shown. Fifteen object balls 101, 102, 103, 104, 105, 106, 107, 108, 109, 110, 111, 112, 113, 114, 115 are arranged on the playing surface, as is the cue ball 120. Nine of the object balls 107, 108, 109, 110, 111, 112, 113, 114, 115 are arranged in a cross 100. Six of the object balls 101, 102, 103, 104, 105, 106, called the perimeter balls 101, 102, 103, 104, 105, 106, are arranged in front of each of the six pockets 210, 211, 212, 213, 214, 215.

Figure 1:
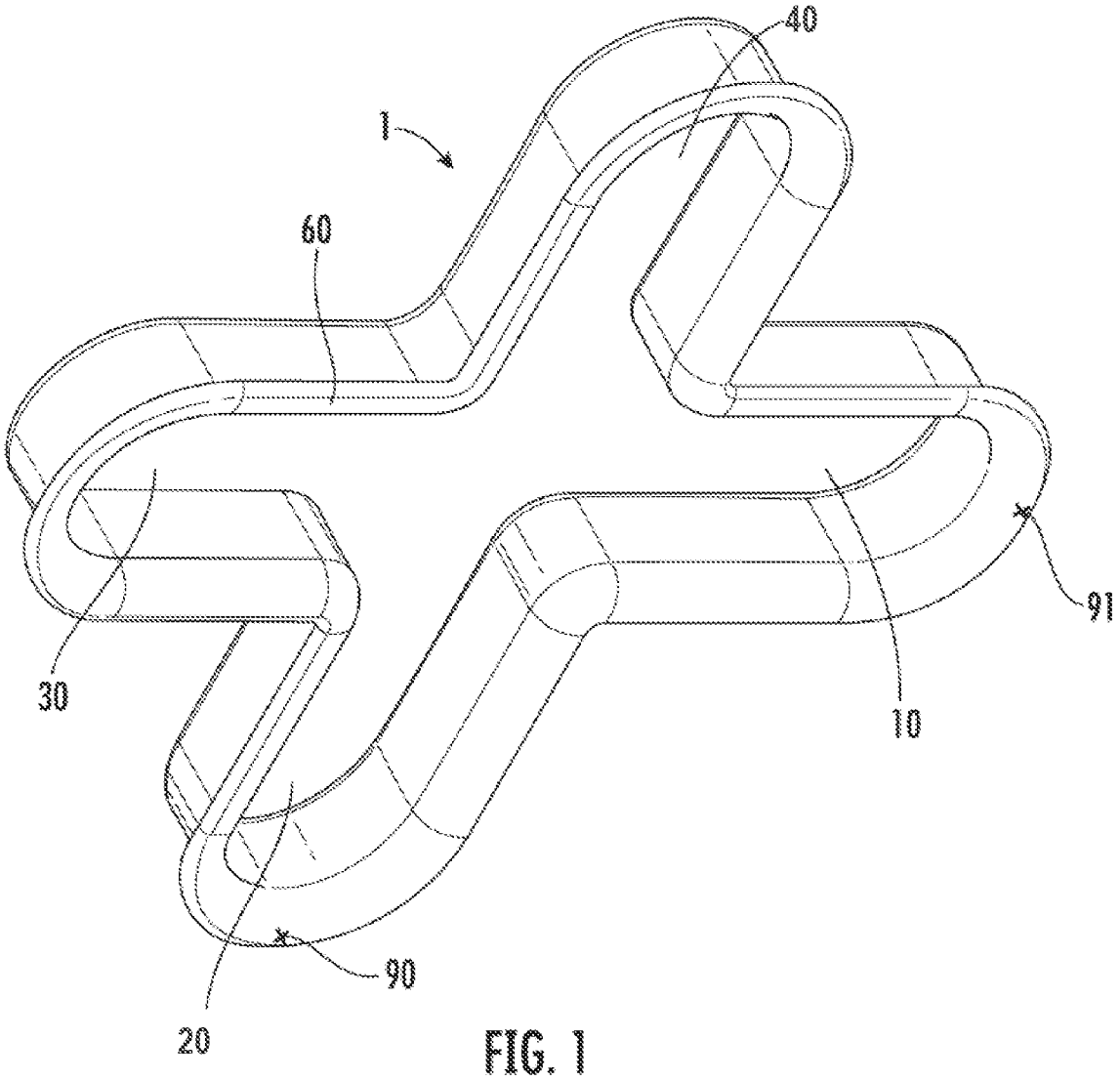
FIG. 1 is a top perspective view of the cross-shaped rack device.
Figure 2:
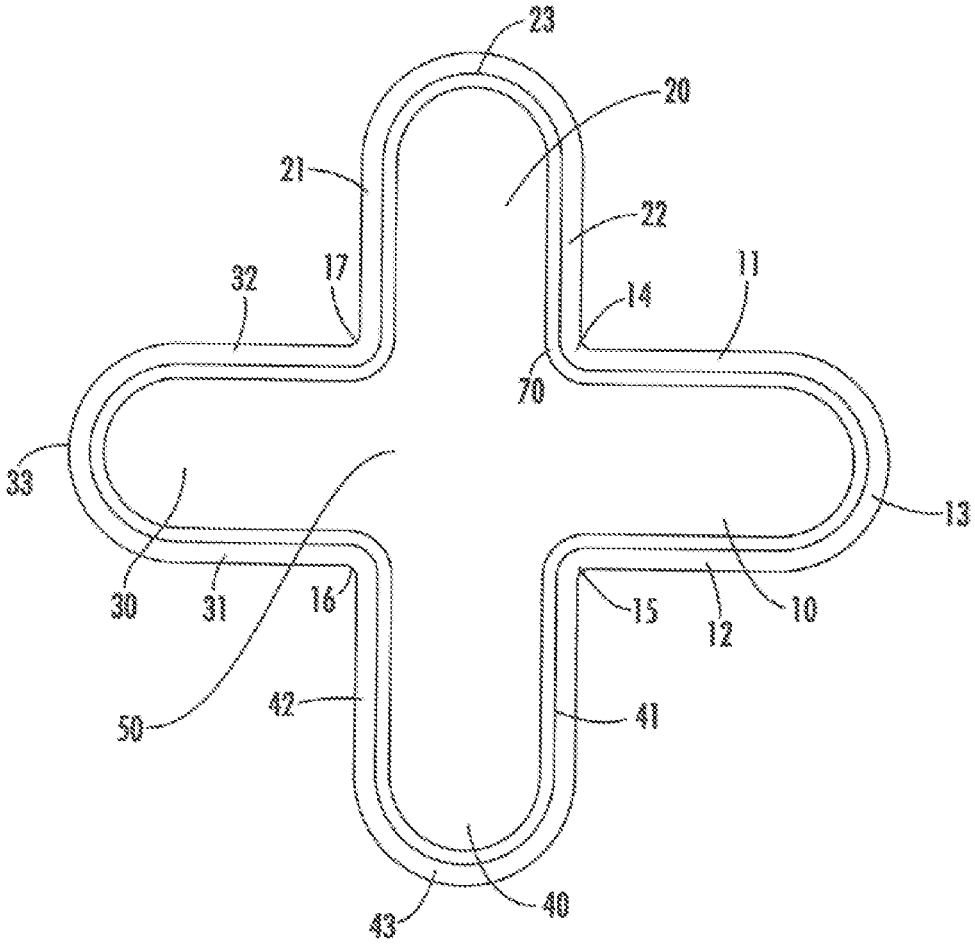
FIG. 2 is a bottom view of the cross-shaped rack device.
Figure 3:
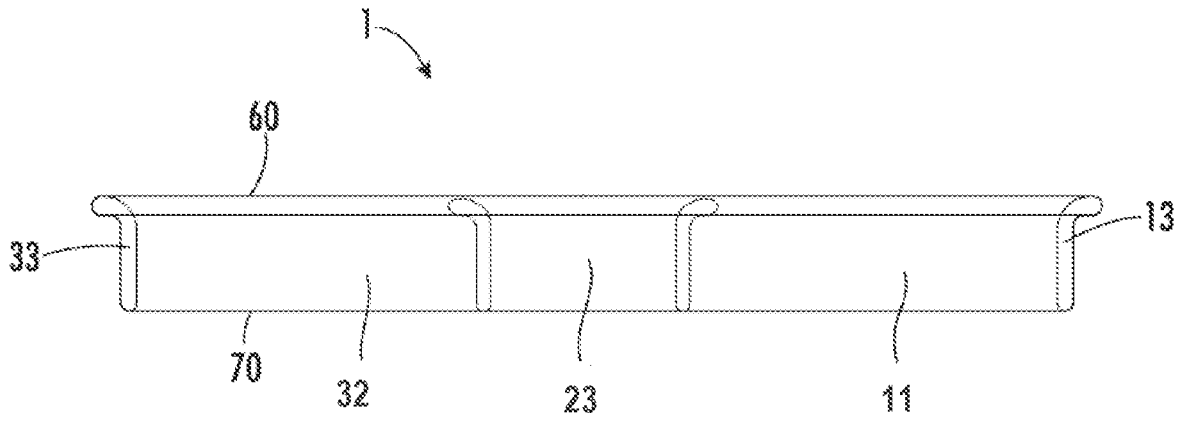
FIG. 3 is a side view of the cross-shaped rack device.

FIGS. 1-3 show the cross-shaped rack device 1 that is used to arrange the nine object balls 107, 108, 109, 110, 111, 112, 113, 114, 115 into a cross 100. FIG. 1 is a top perspective view. FIG. 2 is a bottom view. FIG. 3 is a side view. The cross-shaped rack device 1 has a top flange 60 defining the top of the device. The cross-shaped rack device 1 has void definable center 50 with four void members 10, 20, 30, 40 radiating from the center 50. For reference, only, 10 is the right void member; 20 is the lower void member; 30 is the left void member; and 40 is the upper void member.

The cross-shaped rack device 1 has a continuous side edge 11, 13, 12, 15, 41, 43, 42, 16, 31, 33, 32, 17, 21, 23, 22, 14. The void definable center 50 and the four void members 10, 20, 30, 40 are all contained within a continuous side edge 11, 13, 12, 15, 41, 43, 42, 16, 31, 33, 32, 17, 21, 23, 22, 14 of the cross-shaped rack device. The top flange 60 is continuous in this illustration. The top flange 60 is orthogonal to the continuous side edge 11, 13, 12, 15, 41, 43, 42, 16, 31, 33, 32, 17, 21, 23, 22, 14.

The right void member 10 has a first straight edge 11 that transitions to a semi-circular edge 13 that transitions to a second straight edge 12. The first edge 11 and the second edge 12 of the right void member 10 are disposed parallel to and opposite one another at a distance slightly greater than a standard billiard object ball. The left void member 30 has a first straight edge 31 that transitions to a semi-circular edge 33 that transitions to a second straight edge 32. The first edge 31 and the second edge 32 of the left void member 30 are disposed parallel to and opposite one another at a distance slightly greater than a standard billiard object ball. The right void member 10 and the left void member 30 are in-line with one another on opposite sides of the void center 50.

The lower void member 20 has a first straight edge 21 that transitions to a semi-circular edge 23 that transitions to a second straight edge 22. The first edge 21 and the second edge 22 of the lower void member 20 are disposed parallel to and opposite one another at a distance slightly greater than a standard billiard object ball. The upper void member 40 has a first straight edge 41 that transitions to a semi-circular edge 43 that transitions to a second straight edge 42. The first edge 41 and the second edge 42 of the upper void member 40 are disposed parallel to and opposite one another at a distance slightly greater than a standard billiard object ball. The upper void member 40 and the lower void member 20 are in-line with one another on opposite sides of the center 50.

The right void member 10 has an "X" 91 on the top flange 60; likewise, the lower void member 20 has an "X" 90 on the top flange 60. The two "X" 90, 91 indicate to the player from which edge the racked object balls are to be pushed. The lower void member 20 and right void member 10 are longer than void members 40 and 30. In this embodiment, the lower void member 20 and the right void member 10 are 9 mm longer than the upper void member 40 and the left void member 30. The extra space allows the person racking the balls to fit their thumb between the rack and the outermost balls. This technique ensures a tight rack which is critical for any proper billiards game.

The upper void member 40 lies between the left void member 30 and the right void member 10. The upper void member 40 is orthogonal to both the left void member 30 and the right void member 10. Likewise, the lower void member 20 lies between the left void member 30 and the right void member 10. The lower void member 20 is orthogonal to both the left void member 30 and the right void member 10.

The lower void member 20 and the right void member 10 are connected with a fillet 14. The right void member 10 and the upper void member 40 are connected with a fillet 15. The upper void member 40 and the left void member 30 are connected with a fillet 16. The left void member 30 and the lower void member 20 are connected with a fillet 17. The cross-shaped rack device 1 also has a bottom edge 70. Nine balls 107, 108, 109, 110, 111, 112, 113, 114, 115 can be placed in the top of the cross-shaped rack device 1 in a cross arrangement 100.

The cross-shaped billiards rack device 1 is fabricated from at least one of wood, steel, zinc, aluminum, nylon, glass-filled nylon, engineered thermoplastic polyurethane ("ETPU"), acrylonitrile butadience styrene ("ABS"), thermoplastic copolyester ("TPC"), high density polyethylene ("HDPE"), low density polyethylene ("LDPE"), polypropylene ("PP"), glass-filled PP, polyethylene terephthalate ("PET"), biaxially-oriented PET ("Mylar"), thermoplastic elastomer ("TPE"), methyl methacrylate ("Acrylic"), and polycarbonate ("PC"). A template rack can be fabricated from Mylar to create the cross, with a depressed hole in the template within which each ball is placed.

FIG. 4 shows the system at the beginning of game play. In this illustrated embodiment, the cross-shaped rack device is constructed so that 9 object balls 107, 108, 109, 110, 111, 112, 113, 114, 115 are arranged in a cross 100 on the playing surface 200 of a standard, six-pocket billiard table 299. For reference, the cross 100 has a center ball 109 with a first pair of object balls 112,113 that are orthogonal to and adjacent with a first long rail 204. The cross 100 has a second pair of object balls 110,111 that are orthogonal to and adjacent with a first short rail 203. The cross 100 has a third pair of object balls 114,115 that are orthogonal to and adjacent with a second long rail 202. The cross 100 has a fourth pair of object balls 107,108 that are orthogonal to and adjacent with a second short rail 201. The cross-shaped billiards rack 1 creates a nine-ball pattern 100 called a cross 100, with a center ball 109 and four pairs of object balls, at ninety-degree increments, radiating away from the center ball 109. The first pair of object balls is 112,113; the second pair of object balls is 110,111; the third pair of object balls is 114,115; and the fourth pair of object balls is 107,108.

In a first method embodiment, to begin play, a player places one perimeter object ball 101, 102, 103, 104, 105, 106 in front, and directly in the center, of each of the six pockets 210, 211, 212, 213, 214, 215. The player uses the cross-shaped billiards rack device 1 to rack the remaining nine object balls 107, 108, 109, 110, 111, 112, 113, 114, 115. In the arrangement shown in FIG. 4, the four pairs of object balls (112,113); (110,111); (114,115); (107,108) radiate away from the center ball 109 at 90-degree increments. The player orients the cross 100 so that one of the pairs of balls in the cross is orthogonal to and adjacent with each of the two short rails and two long rails (e.g. a first pair of object balls 112,113 orthogonal to and adjacent with the first long rail 204; a second pair of object balls 110,111 orthogonal to and adjacent with a first short rail 203; a third pair of object balls 114,115 orthogonal to and adjacent with a second long rail 202; and a fourth pair of object balls 107,108 that are orthogonal to and adjacent with a second short rail 201). The player places the cue ball 120 anywhere on the table;

The player uses a cue to strike the cue ball 120 so as to sink at least a first perimeter object ball 101, 102, 103, 104, 105, 106 into a pocket 210, 211, 212, 213, 214, 215 without having any perimeter object ball 101, 102, 103, 104, 105, 106, or the cue ball 120, impact the cross 100. Using the cue to strike the cue ball 120 is referred to as taking a shot. The player then takes shots, sequentially, to sink a second, third, fourth, fifth, and sixth perimeter object ball (e.g., 101, 102, 103, 104, 105, 106) without having any ball (e.g., 101, 102, 103, 104, 105, 106, 120) impact the cross 100, ensuring that at least one perimeter object ball (e.g., 101, 102, 103, 104, 105, 106) goes into a pocket (e.g., 210, 211, 212, 213, 214, 215) with each shot.

Figure 5:
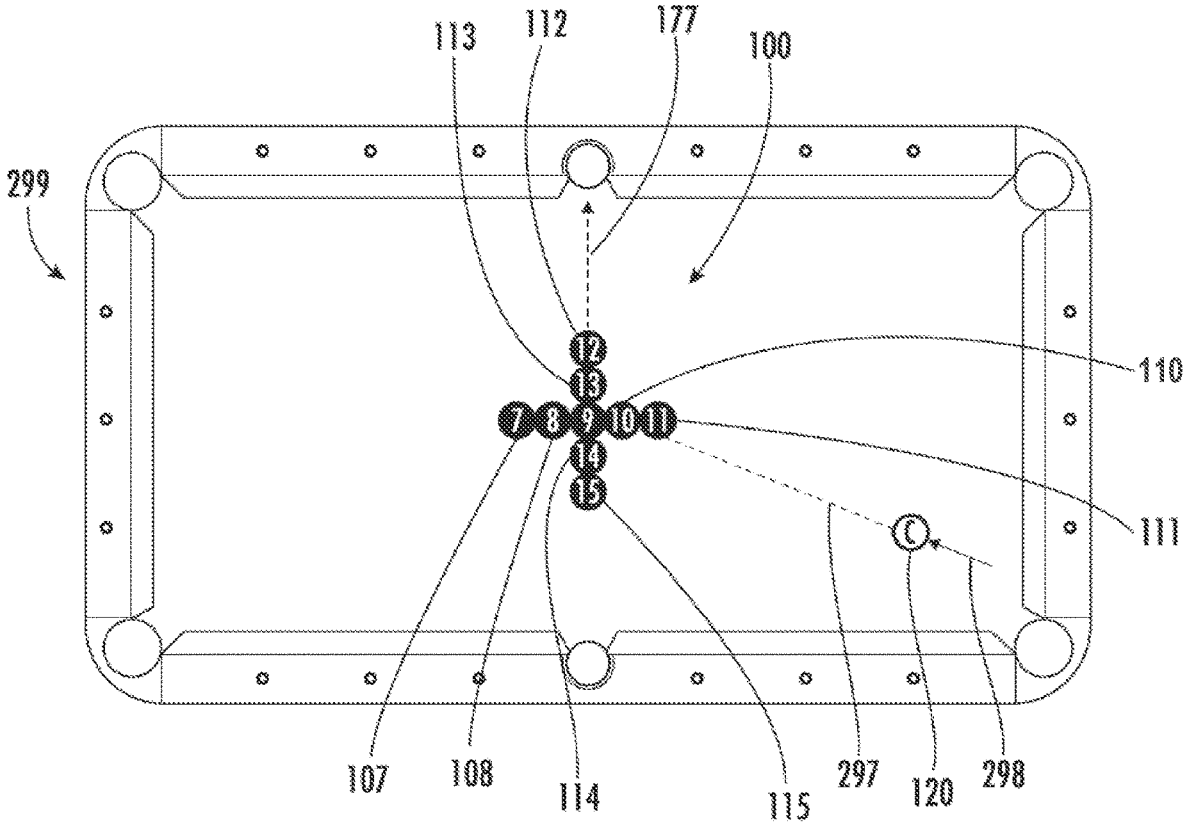
FIG. 5 is a top view of nine remaining object balls forming a cross during game play of Conquer the Cross.

As shown in FIG. 5, once perimeter object balls one through six (e.g., 101, 102, 103, 104, 105, 106) are sunk the player takes a shot 298 so as to hit 297 one or more object balls (107, 108, 110, 111, 112, 113, 114, 115) in the cross 100. This is referred to as breaking the cross 100. The player must get at least one object ball (e.g., 112) into a pocket 177 when breaking the cross 100. The player continues to take shots, sequentially, so that at least one of the remaining object balls goes into a pocket with each shot, until such time as there are no object balls remaining on the table.

Figure 7:
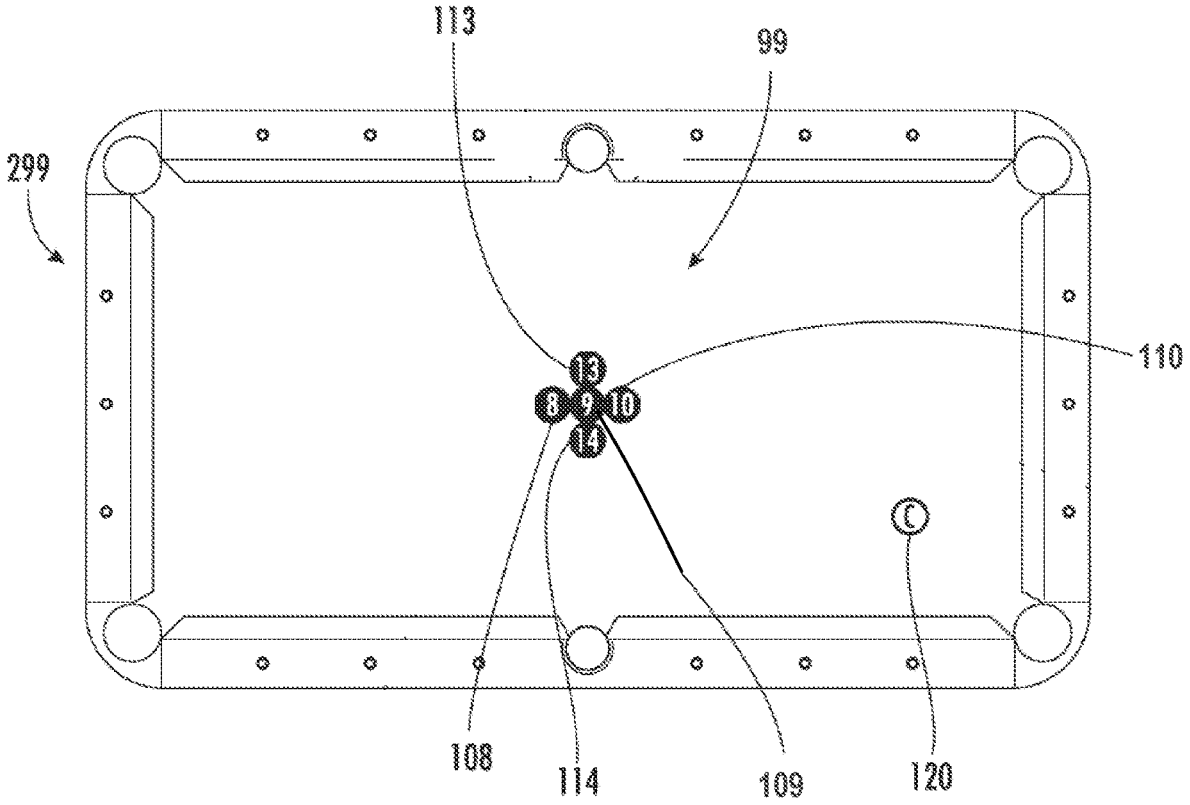
FIG. 7 is a top view of a mini-cross made with five object balls.
Figure 8:
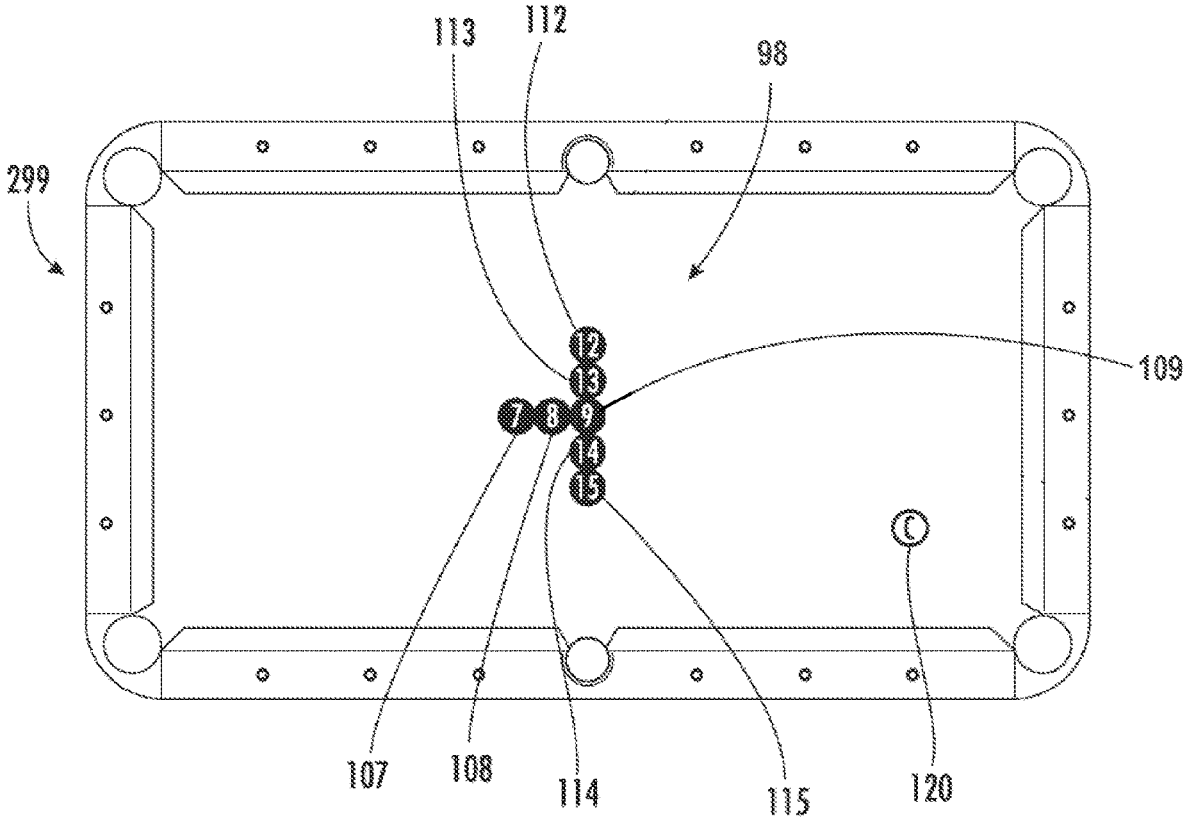
FIG. 8 is a top view of an unbalanced cross made with seven balls.

FIG. 7 shows a variation using a mini-cross 99 composed of 5 object balls 108, 109, 110, 113, 114. The mini-cross 99 would be broken like the regular cross 100 using the cue ball 120. Likewise, FIG. 8 shows a variation using an unbalanced cross 98 composed of 7 object balls 107, 108, 109, 112, 113, 114, 115. The unbalanced cross 98 would be broken like the regular cross 100 using the cue ball 120.

Figure 6:
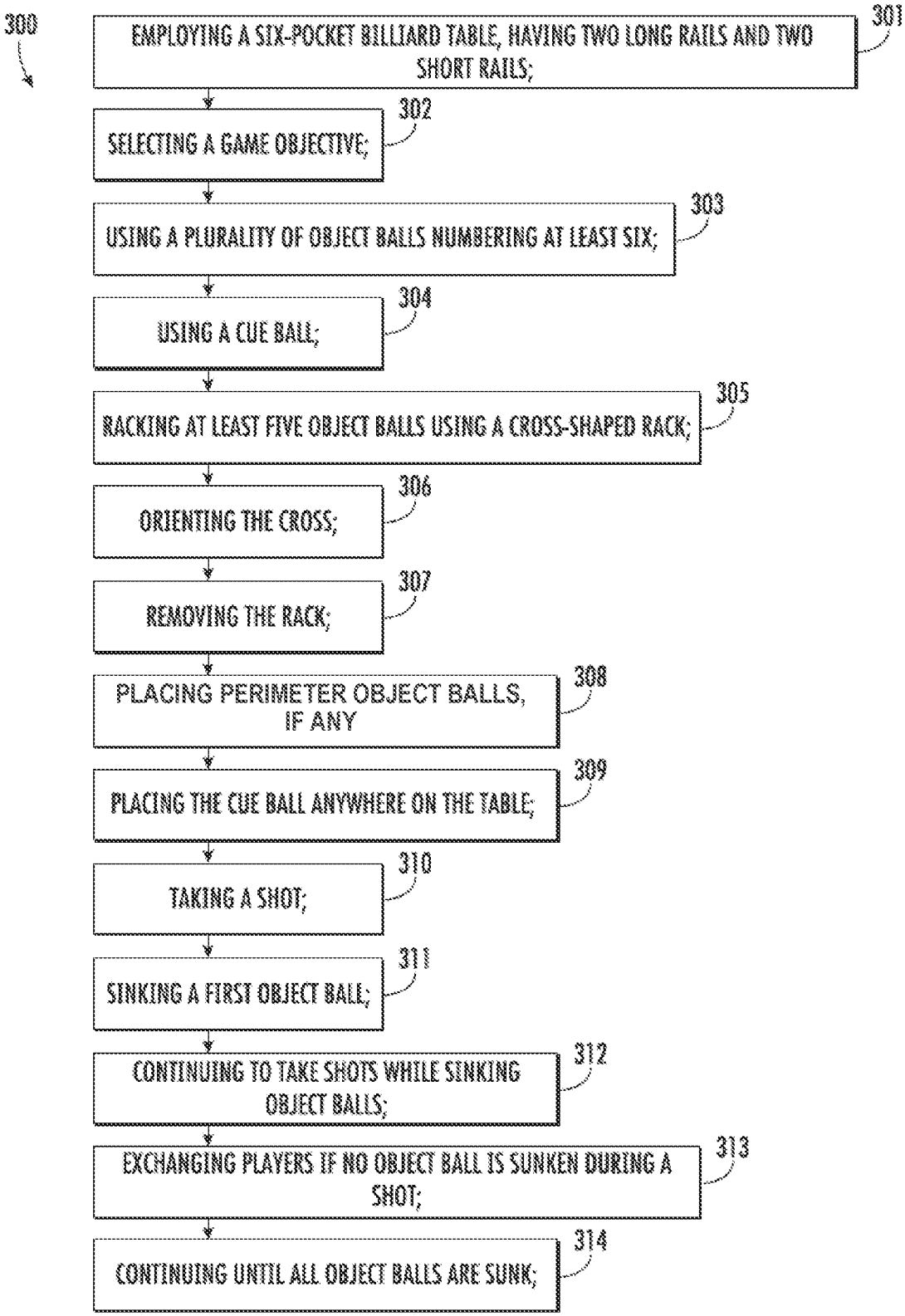
FIG. 6 is a flow chart showing the primary method of the invention.

FIG. 6 shows the primary method 300 of this invention. The game employs 301 a six-pocket billiard table 299, having two long rails 202, 204 and two short rails 201, 203.

Next, the participant(s) select a game objective 302. In the first embodiment, the game objective 302 entails employing 15 object balls 101, 102, 103, 104, 105, 106, 107, 108, 109, 110, 111, 112, 113, 114, 115. Nine object balls (e.g., 107, 108, 109, 110, 111, 112, 113, 114, 115) are put in a cross 100. The remaining perimeter object balls (e.g., 101, 102, 103, 104, 105, 106) are arranged so that one is in front of each pocket 210, 211, 212, 213, 214, 215. Although there are six object balls remaining (e.g., 101, 102, 103, 104, 105, 106), fewer than six may be used as perimeter object balls. In fact, the game can be played without any perimeter balls. If perimeter balls are used, the perimeter object balls 101, 102, 103, 104, 105, 106 are placed in front of the pockets 210, 211, 212, 213, 214, 215. The perimeter object balls 101, 102, 103, 104, 105, 106 are sunk without disturbing the cross 100. Once there are no more perimeter object balls on the playing surface 200, the cross 100 is broken. If a player disturbs the cross 100 prior to sinking all of the perimeter object balls 101, 102, 103, 104, 105, 106, the player loses.

In a second embodiment, the game objective mirrors that employed in the first embodiment, but a mini-cross 99 composed of 5 object balls 108, 109, 110, 113, 114 is used. Although there are ten object balls remaining (e.g., 101, 102, 103, 104, 105, 106, 107, 111, 112, 115), fewer than ten may be used as perimeter object balls. In fact, the game can be played without any perimeter balls. If perimeter balls are used, a maximum of six perimeter object balls (e.g., 101, 102, 103, 104, 105, 106) are placed in front of the pockets 210, 211, 212, 213, 214, 215. The remaining perimeter object balls 107, 111, 112, 115 can be incorporated in game play, if desired, although they are not necessary. The perimeter object balls 101, 102, 103, 104, 105, 106, 107, 111, 112, 115 are sunk without disturbing the mini-cross 99. Once there are no more perimeter object balls on the playing surface 200, the mini-cross 99 is broken. If a player disturbs the mini-cross 99 prior to sinking all of the perimeter object balls 101, 102, 103, 104, 105, 106, the player loses.

In a third embodiment, the game objective also mirrors that employed in the first embodiment, but with an unbalanced cross 98 composed of 7 object balls 107, 108, 109, 112, 113, 114, 115. Although there are eight object balls remaining (e.g., 101, 102, 103, 104, 105, 106, 110, 111), fewer than eight may be used as perimeter object balls. In fact, the game can be played without any perimeter balls. If perimeter balls are used, a maximum of six perimeter object balls (e.g., 101, 102, 103, 104, 105, 106) are placed in front of the pockets 210, 211, 212, 213, 214, 215. The remaining perimeter object balls 110, 111 can be incorporated in game play, if desired, although they are not necessary. The perimeter object balls (e.g., 101, 102, 103, 104, 105, 106) are sunk without disturbing the unbalanced cross 98. Once there are no more perimeter object balls on the playing surface 200, the unbalanced cross 98 is broken. If a player disturbs the unbalanced cross 98 prior to sinking all of the perimeter object balls (e.g., 101, 102, 103, 104, 105, 106) the player loses.

In a variation of the game objective 302 that can used with any of embodiments one through three in a multiplayer game, an opponent may dictate the order in which the perimeter object balls (e.g., 101, 102, 103, 104, 105, 106) are to be sunk.

In another variation of the game objective 302 that can used with any of embodiments one through three, fewer than six perimeter object balls (e.g., 101, 102, 103, 104, 105) may be placed in front of fewer than six pockets (e.g., 210, 211, 212, 213, 214). In this variation, the cross 100, mini-cross 99, or unbalanced cross 98 is broken to start the game. The player(s) have to sink all of the object balls used in the cross 100, mini-cross 99, or unbalanced cross 98, prior to sinking the perimeter object balls (e.g., 101, 102, 103, 104, 105) that have been placed in front of the pockets (e.g., 210, 211, 212, 213, 214). If a player disturbs or sinks any of the perimeter object balls (e.g., 101, 102, 103, 104, 105), the player loses.

Once the game objective 302 is defined, a plurality of object balls numbering at least five 303 is employed in order to facilitate the game objective 302. In addition, a cue ball is used 304. At least five object balls are placed 305 into a cross-shaped rack 1. The cross 100 is oriented 306. The user puts their thumbs into the rack at the X 90, 91 to insure a tight configuration. Perimeter object ball(s), if any, are placed 308 according to the game objective 302. The cue ball 120 is placed 309 anywhere on the playing surface 200 of the billiard table 299. A shot is taken 310 by a first player. If an object ball is sunk 311 in accordance with the game objective 302, the first player continues shooting. If not, another player shoots, if there is more than one player playing. A player continues to take shots while sinking object balls 312. The players exchange turns if no object balls are sunken during a shot 313. This is continued until all object balls are sunken 314. If the player successfully conquer the cross 100, 99, 98, by meeting the game objective 302, the player sinking the last object ball wins. However, if a player violates the game objective 302, by, for instance, inadvertently breaking the cross (e.g., 100), the player loses.

In an alternative embodiment, a player must call the object ball for each shot. If the player fails to sink the object ball, the game is terminated.

In an alternative embodiment, a player must call the object ball and pocket for each shot. If the player fails to sink the object ball so called, or if the called object ball lands in the wrong pocket, the game is terminated.

In another alternative embodiment, the cue ball must strike the object ball the player intends on sinking, prior to the cue ball hitting any other object balls. If the cue ball strikes another object ball, first, the game is terminated.

In another alternative embodiment, the opponent calls the object ball for each shot. The game is terminated if the called object ball fails to be sunk. In another alternative embodiment, an opponent may call the object ball of each shot, consistent with the game objective.

The game objectives of embodiments one through three may also include scoring. For example, with embodiment one, a point system can be established whereby the perimeter object balls are worth one point a piece; the first eight balls of the cross 100 are worth two points each; and the final ball from the cross 100 is worth three points. A perfect game using this scoring system on embodiment one would yield 25 points.

In an alternative embodiment, when playing versus an opponent, a series of games can be played until one of the players reaches a pre-determined point goal (i.e., 100 points). In an alternative embodiment with multiple players, a pre-determined number of games can comprise a series. The player with the highest point total in the series wins.

In an alternative embodiment using a scoring system, the players can be reset to the beginning of a game whenever a player misses or clears the table.

In an alternative embodiment using a scoring system with multiple players, a score can be tabulated for each player in each game. A series can be an odd number of games. The winner is the player who wins the most games in a series, regardless of aggregate score.

We claim:

1. A cross-shaped billiards rack device comprising a continuous side edge defining a void definable center; and four void members radiating from the void definable center;

wherein the four void members are denominated right, upper, left, and lower;

wherein the right and left void members are in-line with one another, disposed opposite one another across the void definable center; and each of the left and right void member are orthogonal to both the upper and lower void members;

wherein the void definable center is so sized as to accept a billiard object ball;

wherein two of the void members, each denoted with an "X", are longer than the other two void members; and wherein each of the four void members is so sized as to accept at least one billiard object ball, and, in aggregate, the four void members are so sized as to accept exactly eight billiard object balls.

2. The cross-shaped billiards rack device of claim 1, where each void member, when viewed from above, has a first straight side edge that transitions to a semi-circular side edge that transitions to a second straight side edge.

3. The cross-shaped billiards rack device of claim 2, wherein the first straight side edge and the second straight side edge are parallel to one another at a distance slightly greater than an object ball.

4. The cross-shaped billiards rack device of claim 3, wherein the cross-shaped billiards rack is capable of containing at most nine standard billiards balls.

5. The cross-shaped billiards rack device of claim 4, wherein each of the four void members is capable of containing, at most, two billiard balls and the definable center is capable of containing, at most, one billiard ball.

6. The cross-shaped billiards rack device of claim 5, wherein the device is fabricated from at least one of wood, steel, zinc, aluminium, nylon, glass-filled nylon, engineered thermoplastic polyurethane ("ETPU"), acrylonitrile butadience styrene ("ABS"), Thermoplastic copolyester ("TPC"), High Density Poly Ethylene ("HDPE"), Low Density Poly Ethylene ("LDPE"), Polypropylene ("PP"), glass-filled PP, and Polyethylene Terephthalate ("PET"), thermoplastic elastomer ("TPE"), methyl methacrylate ("Acrylic"), biaxially-oriented PET ("Mylar"), and polycarbonate ("PC").

7. The cross-shaped billiards rack device of claim 6, wherein a continuous top flange extends from the continuous side edge.

8. The cross-shaped billiards rack device of claim 7, wherein a first "X" is placed on the flange where the flange attaches to the semi-circular side edge of a first void member.

9. The cross-shaped billiards rack device of claim 8, wherein a second "X" is placed on the flange where the flange attaches to the semi-circular side edge of a second void member; the second void member being orthogonal to the first void member.

10. The cross-shaped billiards rack device of claim 9, wherein the first "X" and second "X" indicate that the first void member and the second void member are longer than the remaining void members.

11. The cross-shaped billiards rack device of claim 10, wherein the first void member and second void member are sized so as to allow a user to insert their fingers at the "X", when the cross-shaped billiards rack device is loaded with object balls.

12. The cross-shaped billiards rack device of claim 10, wherein the continuous top flange is orthogonal to the continuous side edge.

* * * * *